US011619214B2

(12) United States Patent
Guender et al.

(10) Patent No.: US 11,619,214 B2
(45) Date of Patent: Apr. 4, 2023

(54) HYDRAULIC MACHINE, HYDRAULIC ASSEMBLY HAVING THE HYDRAULIC MACHINE, AND HYDRAULIC AXLE HAVING THE HYDRAULIC MACHINE

(71) Applicant: Robert Bosch GmbH, Stuttgart (DE)

(72) Inventors: Andreas Guender, Ramsthal (DE); Jan Lukas Bierod, Bad Camberg (DE); Johannes Schwacke, Bad Orb (DE); Saskia Ryznar, Marktheidenfeld (DE); Oleg Stefanjuk, Partenstein (DE); Marco Scholz, Burgsinn (DE); Emil Hanauer, Abtswind (DE); Rene Huettl, Chemnitz (DE)

(73) Assignee: Robert Bosch GmbH, Stuttgart (DE)

( * ) Notice: Subject to any disclaimer, the term of this patent is extended or adjusted under 35 U.S.C. 154(b) by 99 days.

(21) Appl. No.: 16/960,970

(22) PCT Filed: Jan. 7, 2019

(86) PCT No.: PCT/EP2019/050202
§ 371 (c)(1),
(2) Date: Jul. 9, 2020

(87) PCT Pub. No.: WO2019/137862
PCT Pub. Date: Jul. 18, 2019

(65) Prior Publication Data

US 2020/0340460 A1 Oct. 29, 2020

(30) Foreign Application Priority Data

Jan. 11, 2018 (DE) ..... 10 2018 200 345.9

(51) Int. Cl.
*F04B 1/2021* (2020.01)
*F04B 1/324* (2020.01)
(Continued)

(52) U.S. Cl.
CPC ..... *F04B 1/2021* (2013.01); *F04B 1/20* (2013.01); *F04B 1/324* (2013.01); *F04B 53/08* (2013.01); *F03C 1/0636* (2013.01); *F04B 1/2042* (2013.01)

(58) Field of Classification Search
CPC ..... F04B 1/30; F04B 1/2064; F04B 1/2035; F04B 1/306; F04B 1/2021; F04B 1/324;
(Continued)

(56) References Cited

U.S. PATENT DOCUMENTS 1,764,753 A * 6/1930 Seagren ..... F04B 39/125 417/243
2006/0171822 A1* 8/2006 Seagar ..... F04B 35/045 417/410.1
(Continued)

FOREIGN PATENT DOCUMENTS

CN 101684783 A 3/2010
CN 106 224 228 A 12/2016
(Continued)

OTHER PUBLICATIONS

International Search Report corresponding to PCT Application No. PCT/EP2019/050202, dated Mar. 25, 2019 (German and English language document) (6 pages).

*Primary Examiner* — Dominick L Plakkoottam
(74) *Attorney, Agent, or Firm* — Maginot, Moore & Beck LLP

(57) ABSTRACT

A hydraulic machine includes a housing interior space and a group of hydrostatic working chambers which are mounted in said housing interior space so as to be rotatable about an axis of rotation and which, as the group rotates, are connectable alternately to a high pressure and to a low pressure of the hydraulic machine and exhibit leakage into the housing interior space. A heat exchanger device is accom-
(Continued)

modated in the housing interior space. The hydraulic machine may be associated with a hydraulic assembly and a hydraulic axle.

15 Claims, 7 Drawing Sheets

(51) Int. Cl.

| | |
|---|---|
| ***F04B 53/08*** | (2006.01) |
| ***F04B 1/20*** | (2020.01) |
| *F03C 1/06* | (2006.01) |
| *F04B 1/2042* | (2020.01) |

(58) Field of Classification Search
CPC ..... F04B 1/2042; F04B 1/2014; F04B 1/20; F04B 53/08; F04B 49/08; F04B 49/065; F04B 39/064; F03C 1/0636
See application file for complete search history.

(56) References Cited

U.S. PATENT DOCUMENTS

| | | | | |
|---|---|---|---|---|
| 2011/0006006 | A1* | 1/2011 | MacHarg | B01D 61/10 210/652 |
| 2017/0159639 | A1* | 6/2017 | Ishikawa | F04B 53/18 |

FOREIGN PATENT DOCUMENTS

| | | | | |
|---|---|---|---|---|
| CN | 106678117 | A | 5/2017 | |
| DE | 27 03 686 | A1 | 8/1978 | |
| DE | 94 11 163 | U1 | 2/1996 | |
| DE | 10 2011 054 623 | A1 | 4/2013 | |
| DE | 102011054623 | A1 * | 4/2013 | F04B 1/2014 |
| DE | 10 2012 000 986 | B3 | 5/2013 | |
| EP | 3 168 470 | A1 | 5/2017 | |
| JP | H8-226412 | A | 9/1996 | |
| WO | WO-2013107648 | A1 * | 7/2013 | H02K 11/33 |

* cited by examiner

HYDRAULIC MACHINE, HYDRAULIC ASSEMBLY HAVING THE HYDRAULIC MACHINE, AND HYDRAULIC AXLE HAVING THE HYDRAULIC MACHINE

This application is a 35 U.S.C. § 371 National Stage Application of PCT/EP2019/050202, filed on Jan. 7, 2019, which claims the benefit of priority to Serial No. DE 10 2018 200.345.9, filed on Jan. 11, 2018 in Germany, the disclosures of which are incorporated herein by reference in their entirety.

The disclosure relates to a hydraulic machine, a hydraulic assembly having the hydraulic machine, and a hydraulic axle having the hydraulic machine.

BACKGROUND

The core of a hydraulic circuit is a hydraulic machine, in particular a hydraulic pump. The latter is used to convert mechanical energy of a pressure medium which it conveys into hydraulic, in particular hydrostatic energy. In the event of operation as a hydraulic motor, the conversion takes place in the opposite direction. During energy conversion, losses occur which, in the event of the hydraulic circuit, lead in particular to heating of the pressure medium. The loss occurring in one or more hydraulic machines is responsible for a large part of the heating of the pressure medium; a much smaller part is caused by flow losses in lines. The pressure medium in the hydraulic pump is particular greatly heated.

In conventional solutions, the thermal energy arising due to losses in the hydraulic pump is displaced by the conveyed pressure medium in the hydraulic circuit until it is dissipated by means of an external heat exchanger as heat to a coolant. The thermal energy is distributed here over a large volume of oil, as a result of which a large quantity of pressure medium has to be circulated in order to dissipate the heat. However, due to the large quantity of pressure medium, a $\Delta T$ with respect to the recooling coolant is comparatively small, and therefore the external heat exchanger is not efficient and the heat exchange surface thereof has to be large, which keeps investment and operating costs high.

The cooling can be undertaken, for example, by an external tubular heat exchanger or plate heat exchanger. The coolant is, for example, water. The two heat exchangers conceal the risk of ingress of water into the hydraulic oil since the oil and cooling water side are separated only via a seal, in the case of the tubular heat exchanger, and only via a thin layer of brazing, in the case of the plate heat exchanger. Both seals may fail due to operationally induced wear and thus put at risk the operating reliability of the hydraulic machine and of the components and processes supplied by the latter due to ingress of water into the hydraulic oil.

Documents DE 94 11 163 U1, JPH 08 22 64 12 and DE 27 03 686 each show a solution in which cooling takes place by flushing a housing interior of the hydraulic pump with pressure medium. The pressure medium discharged in this manner from the hydraulic pump is recooled with water in a separately arranged heat exchanger. The quantity of pressure medium that has circulated is also large here. In addition, the quantity flushed out has to be continuously replaced, which involves an outlay in terms of apparatus.

Document CN 106 224 228 discloses a hydraulic pump, with a heat tube wound around its housing. Heat is finally dissipated by recooling the medium of the heat tube via a water bath. A disadvantage of this solution, for example, is that the heat tube is exposed to damage due to impact because of being arranged on the outer side of the hydraulic pump.

A related solution is disclosed by document DE 10 2012 000 986 B3, in which a cooling jacket for a hydraulic pump is proposed. A disadvantage in this case is that such a cooling jacket structure can take up a comparatively large amount of structural space.

SUMMARY

By contrast, the disclosure is based on the object of providing a hydraulic machine having more efficient cooling, a hydraulic assembly having the hydraulic machine and a hydraulic axle having the hydraulic machine.

The first object is achieved by a hydraulic machine having the features described herein, the second by a hydraulic assembly having the features described herein, and the last by a hydraulic axle having the features described herein.

Advantageous developments of the disclosure are described hereinafter.

A hydraulic machine has a housing interior and a group of hydrostatic working chambers which is mounted therein so as to be rotatable about an axis of rotation. Said working chambers, upon rotation of the group, are connectable in an alternating manner to a high pressure and a low pressure of the hydraulic pump, in particular to a corresponding connection. During the operation of the hydraulic machine, the pressure medium heats up. The working chambers here have a leakage volume flow into the housing interior. According to the disclosure, a heat exchanger device is accommodated in the housing interior for cooling purposes. In particular, said heat exchanger device comes into contact with the leakage volume or leakage volume flow.

The $\Delta T$ is particularly high because of the arrangement of the heat exchanger device close to the location of heating of the pressure medium. A turbulent swirling of a pressure medium quantity present in the housing interior because of the leakage is also high because of the rotating working chambers. Even one of the two factors mentioned leads to an improved heat transfer, and the two together make the heat transfer particularly efficient. A small and simply constructed heat exchange surface in the housing interior is therefore sufficient. A particularly efficient arrangement of the component required for cooling purposes is realized by the heat exchanger device being accommodated in the housing interior.

The hydrostatic working chambers are preferably each bounded by a hydrostatic cylinder/piston unit of the hydraulic machine.

Preferably, the hydraulic machine is an axial piston machine and the cylinders are formed by cylinder bores formed in a rotatable cylinder drum. The pistons are arranged in an axially displaceable manner in said cylinder bores.

The axial piston machine is preferably embodied in a swash plate type of construction, wherein the pistons are supported in a sliding manner on a swash plate which is arranged fixed on the housing or is mounted pivotably. Alternatively, a bent axis type of construction is possible, wherein the piston heads are connected non-rotatably to a drive shaft lined up with the axis of rotation.

In a development, the heat exchanger device at least in sections occupies an annular chamber which extends radially and axially between a housing inner wall and the group. The annular chamber is particularly appropriate since it is present in any case and does not have to be expanded, or has to be only slightly expanded, for the arrangement of the heat exchanger device. The hydraulic machine is nevertheless small despite the heat exchanger device arranged in the housing interior.

In a development, the annular chamber extends cylindrically in the direction of the axis of rotation and around the latter at least in sections. It can alternatively or additionally have a conical or oval section in order, for example, to promote a turbulent swirling of the leakage volume or leakage volume flow and thus to make the heat transfer even more efficient.

In a development, the axis of rotation is engaged around by the heat exchanger device in an annular, in particular circular manner, or in a polygonal manner, in particular in a square or hexagonal or octagonal manner. The shapes mentioned relate to a projection of a contour, in particular of an outer and/or inner contour of the heat exchanger device, into a plane, the normal of which is the axis of rotation.

A wall of the heat exchanger device is preferably formed by a tube. In particular, at least the profile thereof in the housing interior, the cross section, wall thickness and/or material are/is configured at least in accordance with the heat to be transmitted as intended and/or the correct temperature of the pressure medium.

A fluid is preferably arranged in a single phase or in two phases, in particular is arranged in a flowing manner, in the heat exchanger device.

A simple structural form of the heat exchanger device that is cost-effective to manufacture is provided if said heat exchanger device, in a development, extends at least in sections helically or spirally about the axis of rotation. A specific temperature profile corresponding to the structural form arises here along the spiral on the side of the coolant and/or on the side of the housing interior.

In order to set a different specific temperature profile along the spiral on the side of the coolant and/or on the side of the housing interior, in an alternative development the heat exchanger device extends at least in sections in an undulating manner around the axis of rotation and in the direction of the axis of rotation. In this case, sections which extend predominantly parallel to or in the direction of the axis of rotation alternate with sections which extend predominantly circumferentially about the axis of rotation.

In order in particular to provide a greater heat exchange surface, in a development the heat exchanger device extends with at least two windings or layers in a direction radially with respect to the axis of rotation.

In a development which is simple to manufacture, a first winding or layer extends radially on the inside in a direction of the axis of rotation as far as an apex of the first winding or layer, is guided radially outward there by an amount at least of a tube diameter of the heat exchanger device and extends with a second winding or layer back from the apex in the opposite direction.

The heat exchanger device can extend circumferentially partially or completely about the axis of rotation, and therefore a structural space of a component of the hydraulic machine that is taken up in the housing interior, in particular in the annular chamber, is bypassed by the heat exchanger device.

In one variant, the housing interior is bounded by a housing through which passes, on an identical side, a drive shaft which is rotatable about the axis of rotation and to which the cylinder/piston units are connected for rotation therewith, and a feed and/or a return of the heat exchanger device.

In a variant, the housing interior is bounded by a housing which, on an identical side, has connections of the high pressure and of the low pressure and through which a feed and/or a return of the heat exchanger device passes.

The feed and/or the return is preferably sealed off from the housing on the outer side thereof. The sealing point is thus easily accessible and can easily be controlled and maintained.

A hydraulic assembly has a hydraulic machine which is designed in accordance with at least one aspect of the preceding description. At least the following are fixedly connected to the hydraulic machine, in particular to the housing thereof: a drive machine, in particular an electric machine, via which a torque can be transmitted to the hydraulic machine, and a pressure medium container which is connectable to the low pressure and/or high pressure of the hydraulic machine. Depending on the configuration of a hydraulic circuit into which the hydraulic machine can be incorporated, the pressure medium container can be designed as an open tank (open circuit) or pressure equalizing container (closed circuit).

An assembly of this type is provided, for example, for supplying pressure medium to a hydraulic cylinder.

Accordingly, a hydraulic axle has a hydraulic machine which is designed in accordance with at least one aspect of the preceding description. At least the following are fixedly connected to the hydraulic machine, in particular to the housing thereof: a drive machine, in particular electric machine, via which a torque can be transmitted to the hydraulic machine, a hydraulic cylinder which can be supplied with pressure medium by the hydraulic machine, and a control block, in particular valve control block, for controlling the pressure medium supply. In addition, as already mentioned above, a tank or a pressure medium container which is connectable to the low pressure and/or high pressure of the hydraulic machine can be provided.

BRIEF DESCRIPTION OF THE DRAWINGS

A number of exemplary embodiments of a hydraulic machine according to the disclosure and of the heat exchanger devices thereof are illustrated in the drawings. The disclosure will now be explained in more detail with reference to the figures of said drawings.

In the drawings.

DETAILED DESCRIPTION

Figure 1:
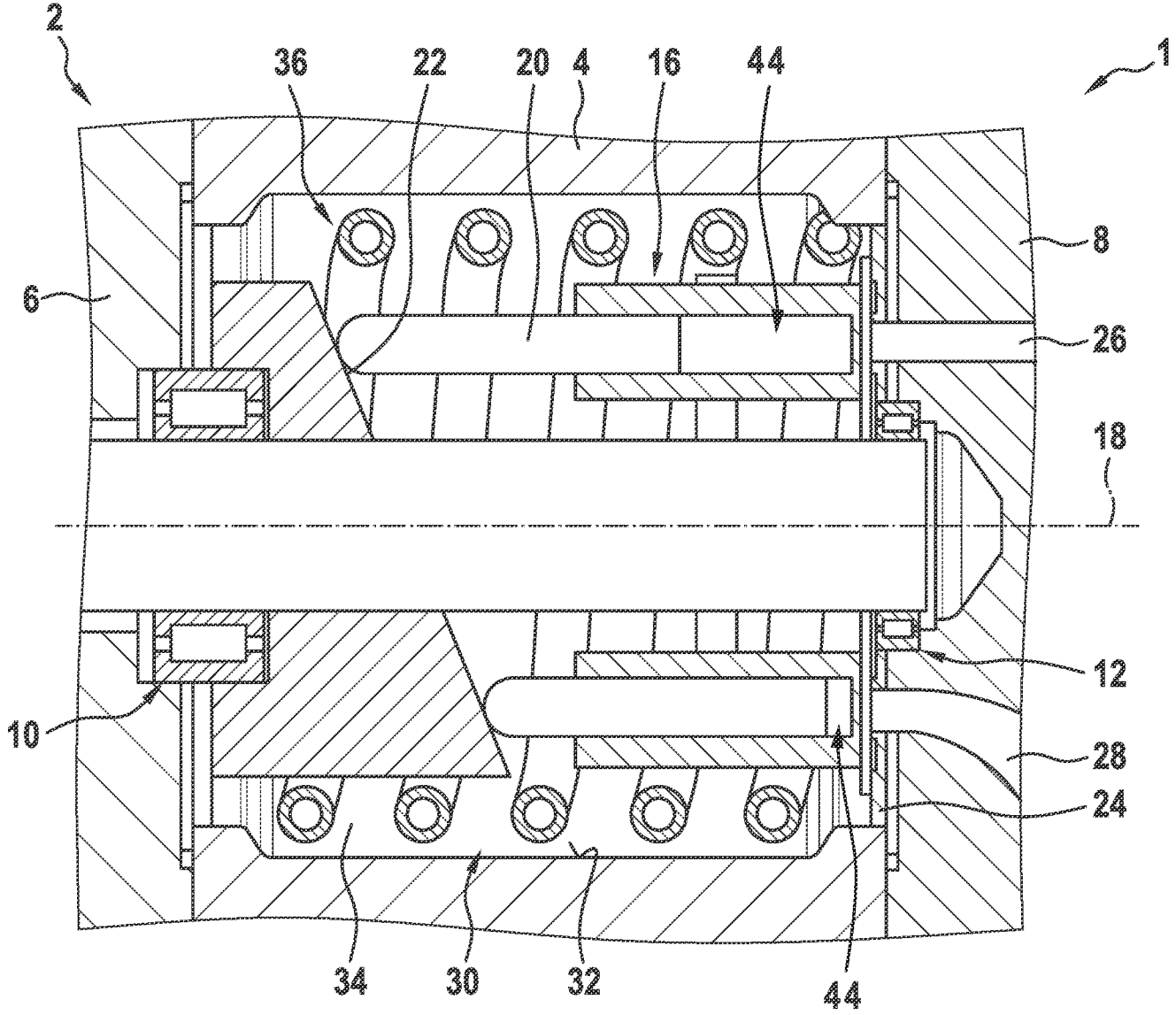
FIG. 1 shows a hydrostatic axial piston pump in a swash plate type of construction according to a first exemplary embodiment, in a longitudinal section.

According to FIG. 1, a first exemplary embodiment of a hydrostatic axial piston pump 1 has a housing 2 with an annular housing jacket 4 which is closed on one end side by a housing cover 6 and on the other end side by a connection cover 8. A drive shaft 14 is mounted rotatably in the housing 2 via rolling bearings 10, 12. A cylinder drum 16 into which a multiplicity of cylinder bores are introduced parallel to the axis of the rotation 18 along a partial circle arranged concentrically with respect to the axis of rotation 18 is connected to the drive shaft 14 for rotation therewith. A hydrostatic working piston 20 is guided in an axially displaceable manner in the respective cylinder bore and is supported in a sliding manner on the housing cover 6, on a swash plate 22 arranged fixedly in the housing 2. In the region of the connection cover 8, a control disk 24 through which passage clearances (not illustrated) pass is arranged between the cylinder drum 16 and the connection cover 8. The passage clearances (kidney-shaped pressure ports) are in pressure medium connection with a high pressure connection 26 and a low pressure connection 28 of the connection cover 8.

When the drive shaft 14, and therefore the cylinder drum 16, are rotated, the hydrostatic working chambers 44 are connected via their openings facing the connections 26, 28 to the high pressure and low pressure in an alternating manner.

A housing interior 30 is formed in the housing 2. An annular chamber 34 is formed radially between the cylinder drum 16 and a housing inner wall 32. A spiral heat exchanger device 36 for dissipating thermal energy from the housing 2 extends in said annular chamber and around the axis of rotation 18. As previously described, the point which is hottest and is most affected by losses is located in a hydraulic circuit in the hydrostatic axial piston pump 1. The heat exchanger device 36 arranged in the annular chamber 34 transmits the thermal energy precisely to said point using coolant, for example water, flowing in the spiral coil. As a result, a $\Delta T$ at this point is very high as is the heat transfer coefficient $\alpha$. A large amount of heat can therefore be transmitted on a small heat exchange surface. As a result, a significantly larger heat exchanger which would have to be provided externally is dispensed with. A saving can thereby be obtained both on investment costs and operating costs. In addition, directly temperature-induced wear phenomena at the hydrostatic axial piston pump can be minimized since the latter can always be operated in the optimum temperature range.

Since the heat is thereby transmitted to the "hottest location" of a hydrostatic circuit, the thermal energy which is dissipated by means of the cooling water can be readily used further since the temperature level of said thermal energy is particularly far above the ambient temperature. As a secondary measure, for example, a hot water supply can thereby be supplied with heat. This can be realized, for example, by a 3 way circuit in which the cooling water circulates in the heat exchanger device 36 until a sufficient $\Delta T$ is reached.

The possible dispensing with the external heat exchanger also dispenses with the error source which has already been discussed further above and is based on the relatively vulnerable technology of the tubular heat exchanger or plate heat exchanger.

A more detailed explanation of the basic construction and of the basic manner of operation of the hydrostatic axial piston machine 1 according to FIG. 1 and the following exemplary embodiments is omitted at this juncture since this is well known from the prior art. The advantages mentioned also apply to the following exemplary embodiments.

Figure 2:
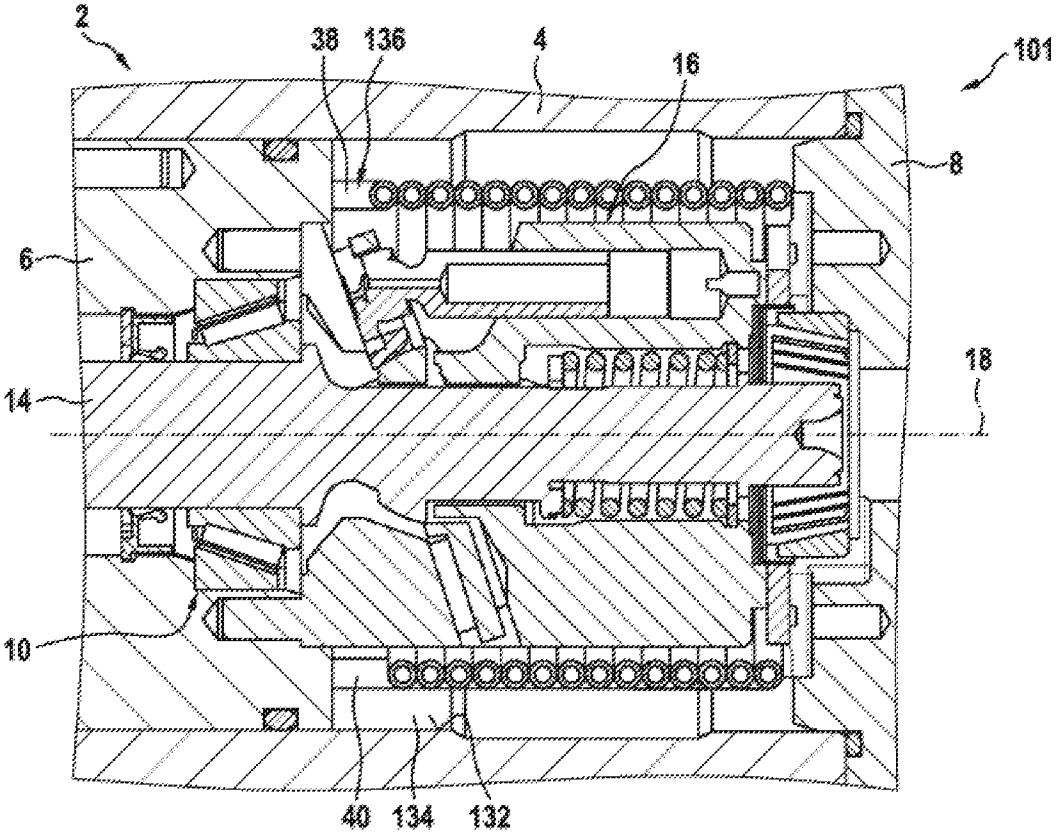
FIG. 2 shows a hydrostatic axial piston pump in a swash plate type of construction according to a second exemplary embodiment, in a longitudinal section.

FIG. 2 shows a hydrostatic axial piston pump 101 according to a second exemplary embodiment. One difference from the first exemplary embodiment according to FIG. 1 is that the heat exchanger device 136 differs from that according to FIG. 1. Although it is also configured as a spiral coil, the individual turns of the spiral coil lie against one another in the axial direction. In addition, a feed 38 and a return 40 of the heat exchanger device 136 are illustrated in FIG. 2. The two 38, 40 pass through the housing cover 6 and are sealed off from the housing 2 on the outer side of said cover (not illustrated). Cooling water flows in the spiral coil of the heat exchanger device 136 through the feed 38 and, on its way through the spiral coil to the return 40, absorbs heat from the leakage oil that is swirled turbulently in the housing interior 134.

As in all of the exemplary embodiments, the turbulence generated in the oil bath of the housing interior 30 by the cylinder drum 16 proves advantageous for the heat transfer coefficient of the heat exchanger device 136. The closer arrangement of the spiral coils of the heat exchanger device 136 increases a heat flow density in comparison to the first exemplary embodiment according to FIG. 1.

Figure 3:
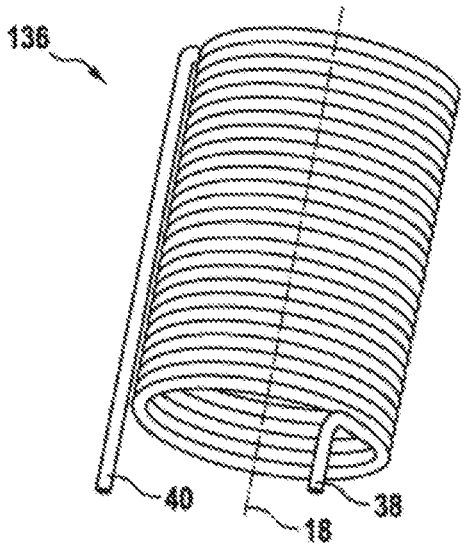
FIG. 3 shows a second exemplary embodiment of a heat exchanger device of the axial piston pump according to FIG. 2 in a perspective view.
Figure 4:
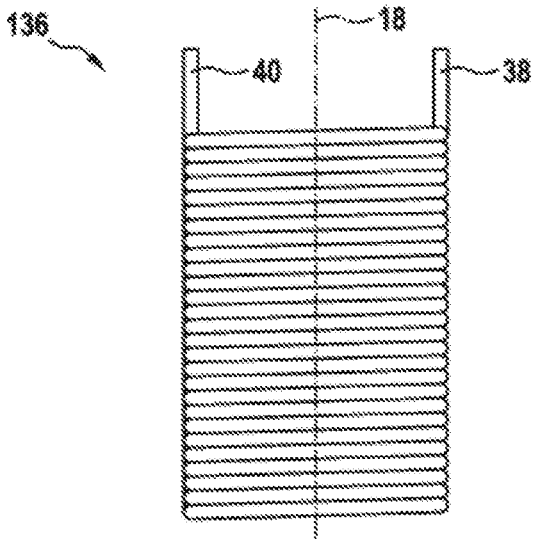
FIG. 4 shows the heat exchanger device according to FIG. 3 in a side view.
Figure 5:
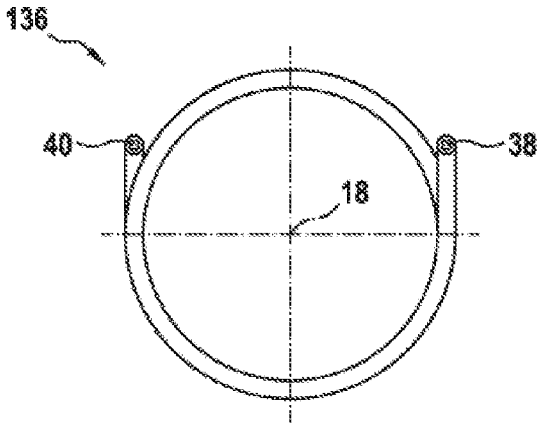
FIG. 5 shows the heat exchanger device according to FIGS. 3 and 4 in a view in the direction of the longitudinal axis.

FIGS. 3 to 5 show the heat exchanger device 136 according to FIG. 2 in a perspective view, a side view and a top view. The comparatively short feed 38 extends parallel to the axis of rotation 18 and is bent at a right angle in the circumferential direction with respect to the axis of rotation 18. The spiral coil subsequently runs with turns lying against one another in the direction of the axis of rotation 18 and circumferentially around the latter until, at an apex of the heat exchanger device 136, the spiral tube peters out tangentially and is bent again at a right angle parallel to the axis of rotation 18 and is guided back as the return 40.

Figure 6:
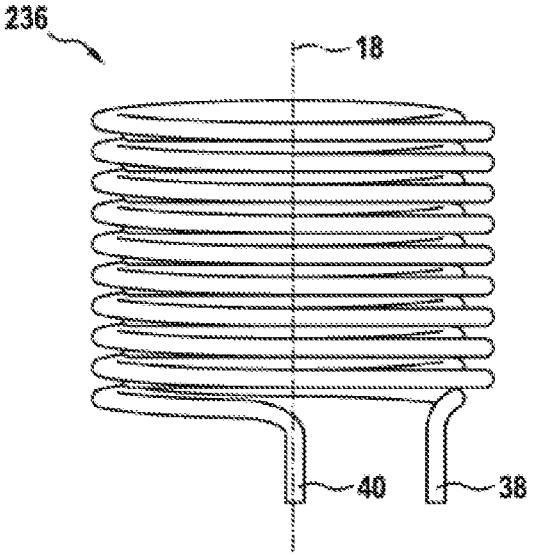
FIG. 6 shows a third exemplary embodiment of a heat exchanger device in a perspective view.

FIG. 6 shows a third exemplary embodiment of a heat exchanger device 236 which builds on the spiral heat exchanger device 36 according to FIG. 1. In contrast to the latter, the heat exchanger device 236 has two layers or windings, instead of only one, in the radial direction. Like the first exemplary embodiment 36 already, the individual turns are at a distance from one another in the direction of the axis of rotation 18. The turbulent oil bath in the housing interior 30 can thereby also reach the intermediate spaces between the turns. Starting from a feed 38, inner turns extend circumferentially and in the direction of the axis 18 with a constant winding diameter as far as an apex of the heat exchanger device 36. The diameter of the winding is expanded here to a larger radius and the turns are guided back circumferentially about the axis of rotation 18 in a reverse direction along the latter. Two windings or layers are thus produced. The outer winding peters out again as the return 40 on the side of the feed 38, in a manner parallel to the latter.

Figure 7:
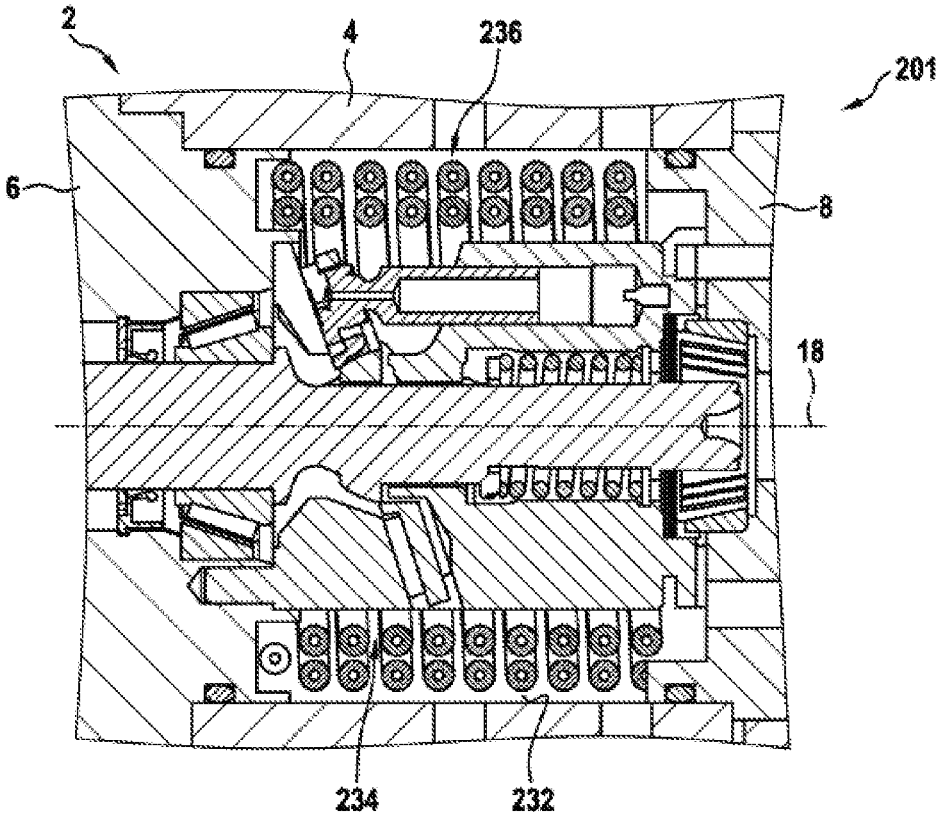
FIG. 7 shows a hydrostatic axial piston pump according to a third exemplary embodiment with the heat exchanger device according to FIG. 6.

FIG. 7 shows a third exemplary embodiment of a hydrostatic axial piston pump 201 which differs from the second exemplary embodiment according to FIG. 2 essentially by the changed heat exchanger device 236 according to FIG. 6.

Figure 8:
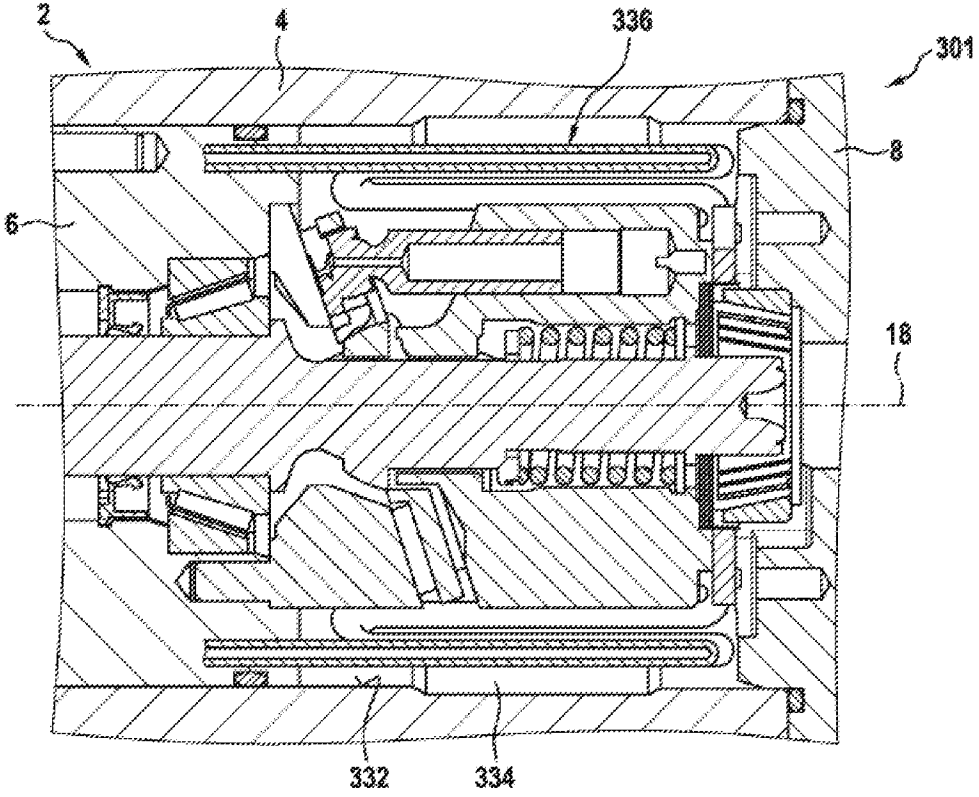
FIG. 8 shows a hydrostatic axial piston pump according to a fourth exemplary embodiment in a longitudinal section.

FIG. 8 shows a fourth exemplary embodiment of a hydrostatic axial piston pump 301 according to the disclosure. It differs from the exemplary embodiment according to FIG. 7 by the modified heat exchanger device 336. The latter, instead of being configured spirally, is now configured in an undulating manner. A ring of circumferentially bent sections extending in an alternating manner parallel to the axis of rotation 18 is strung together here in such a manner that the tube of the heat exchanger device 336 extends in an alternating manner in the circumferential direction around the axis of rotation 18. A temperature profile of the temperature difference ΔT that deviates from the previously shown exemplary embodiments can thereby be realized.

Figure 9:
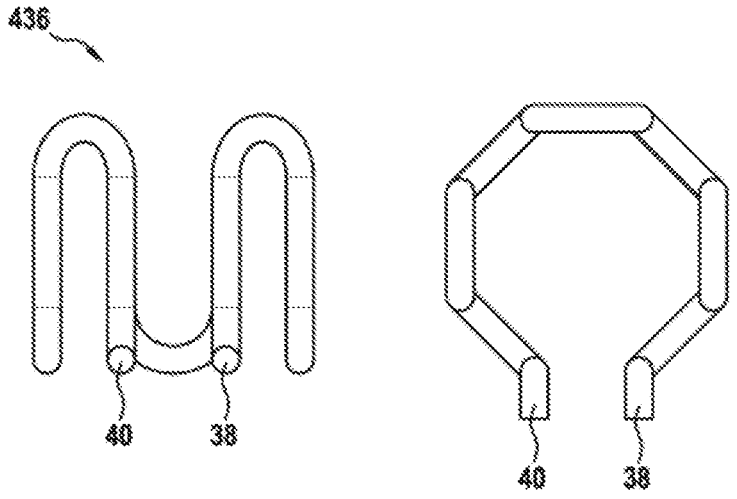
FIG. 9 shows a heat exchanger device according to a fifth exemplary embodiment in a side view and a top view.

A very similarly constructed exemplary embodiment of a heat exchanger device 436 is shown in FIG. 9. The heat exchanger device 436 differs from the exemplary embodiment according to FIG. 8 in that comparatively few undulating sections are provided.

Figure 10:
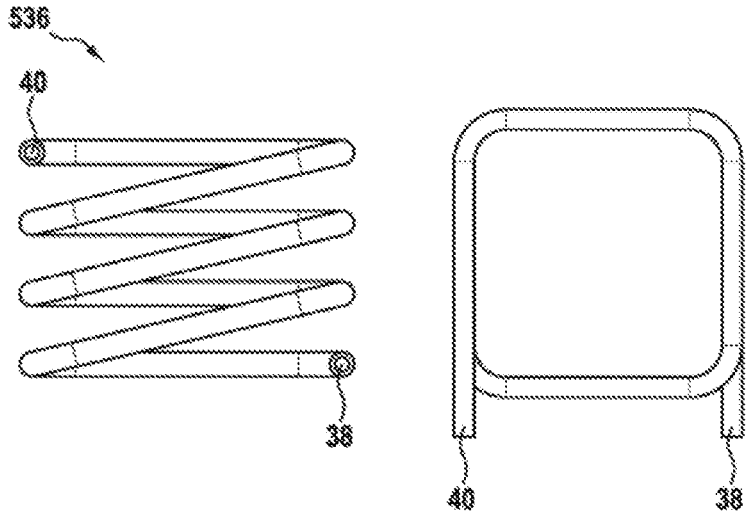
FIG. 10 shows a heat exchanger device according to a sixth exemplary embodiment in a side view and in a top view.

A final exemplary embodiment of a heat exchanger device 536 is shown in FIG. 10. This heat exchanger device extends spirally incrementally and also has a rectangular cross section of the spiral coils. The latter run horizontally in sections, i.e. in a plane, the normal of which is the axis of rotation 18, and are connected to one another by sections placed in each case against the planes. A heat exchanger device coiled in an in principle incremental and spiral manner is thereby produced.

A hydraulic machine having a housing interior in which an engine is arranged via which mechanical energy can be converted into hydraulic energy, and/or vice versa, in a leakage-affected manner is disclosed. A heat exchanger device for removing a heat flow of the leakage is arranged at least in sections in the housing interior.

A hydraulic axle 7 has a hydraulic machine, shown as the axial piston pump 1, which, in accordance with at least one aspect of the preceding description, at least the following are fixedly connected to the hydraulic machine, in particular to the housing 2 thereof: a drive machine 9, in particular an electric machine, via which a torque can be transmitted to the hydraulic machine, a hydraulic cylinder 11 which can be supplied with pressure medium by the hydraulic machine, and a control block 13, in particular a valve control block, for controlling the pressure medium supply. In addition, as already mentioned above, a tank or a pressure medium container 15 which is connectable to the low pressure and/or high pressure of the hydraulic machine can be provided.

Furthermore, a hydraulic assembly and a hydraulic axle which each have the hydraulic machine are disclosed.

LIST OF REFERENCE SIGNS

1; 101; 201; 301 Hydrostatic axial piston pump
2 Housing
4 Housing jacket
6 Housing cover
8 Connection cover
10, 12 Rolling bearings
14 Drive shaft
16 Cylinder drum
18 Axis of rotation
20 Working piston
22 Swash plate
24 Control disk
26 High pressure connection
28 Low pressure connection
30 Housing interior
32 Housing inner wall
34; 134; 234; 334 Annular chamber
36; 136; 236; 336; 436; 536 Heat exchanger device

The invention claimed is:

1. A hydraulic machine comprising:
a housing interior;
a group of hydrostatic working chambers mounted in the housing interior and configured for rotation about an axis of rotation, said working chambers configured such that, upon rotation of the group, said working chambers are connectable in an alternating manner to a high pressure connection of pressure medium of the hydraulic machine and to a low pressure connection of the pressure medium of the hydraulic machine;
a plurality of pistons, each piston at least partially positioned within a corresponding working chamber of the group of hydrostatic working chambers;
a swash plate operably connected to the plurality of pistons, wherein the pressure medium is located in a portion of the housing interior that includes the swash plate; and
a heat exchanger device including a spiral tube portion located in at least the portion of the housing interior including the swash plate, the spiral tube portion defining an interior space that is isolated from the housing interior, such that the pressure medium is spaced apart from the interior space of the spiral tube portion, and the spiral tube portion defining an exterior tube surface that is in contact with the pressure medium.

2. The hydraulic machine as claimed in claim 1, wherein the spiral tube portion, at least in sections, is located in an annular chamber of the housing interior that is defined between a housing inner wall and hydrostatic cylinder/piston units bounding the working chambers.

3. The hydraulic machine as claimed in claim 2, wherein the annular chamber extends in a direction of the axis of rotation and around the axis of rotation.

4. The hydraulic machine as claimed in claim 1, wherein the spiral tube portion of the heat exchanger device surrounds the axis of rotation in one of an annular and a polygonal manner.

5. The hydraulic machine as claimed in claim 1, wherein:
a fluid is arranged in a single phase or in two phases in the interior space of the spiral tube portion of the heat exchanger device, and
the fluid is water.

6. The hydraulic machine as claimed in claim 1, wherein:
the spiral tube portion is a first spiral tube portion,
the heat exchanger device includes a second spiral tube portion located in the housing interior,
the first and second spiral tube portions extend coaxially along the axis of rotation, and
the first and second spiral tube portions overlap each other along the axis of rotation.

7. The hydraulic machine as claimed in claim 1, further comprising:
a housing which defines the housing interior, the housing having a first side configured such that:
a drive shaft which is rotatable about the axis of rotation and to which the swash plate and cylinder/piston units are connected for rotation therewith, and a feed and a return of the heat exchanger device pass through the first side; or
connections of the high pressure and of the low pressure and the feed and the return of the heat exchanger device pass through the first side.

8. The hydraulic machine as claimed in claim 3, wherein the annular chamber extends around the axis of rotation predominantly in one of a cylindrical, a conical, and an oval manner.

9. The hydraulic machine as claimed in claim 1, wherein the spiral tube portion extends around the axis of rotation in one of a circular, a square, a hexagonal, and an octagonal manner.

10. The hydraulic machine as claimed in claim 1, wherein:

the spiral tube portion includes a plurality of turns defining the spiral tube portion, and the turns are positioned against each other along the axis of rotation.

11. The hydraulic machine as claimed in claim 1, wherein: an exterior piston surface of each piston of the plurality of piston is located between the swash plate and the group of hydrostatic working chambers, and each of the exterior piston surfaces is located in the portion of the housing interior including the swash plate and is in contact with the pressure medium.

12. A hydraulic assembly comprising:

a hydraulic machine comprising:

a housing defining a housing interior;

a group of hydrostatic working chambers mounted in the housing interior configured for rotation about an axis of rotation, said working chambers configured such that, upon rotation of the group, said working chambers are connectable in an alternating manner to a high pressure connection of pressure medium of the hydraulic machine and to a low pressure connection of pressure medium of the hydraulic machine;

a plurality of pistons, each piston at least partially positioned within a corresponding working chamber of the group of hydrostatic working chambers;

a swash plate operably connected to the plurality of pistons, wherein the pressure medium is located in a portion of the housing interior that includes the swash plate; and a heat exchanger device including a spiral tube portion located at least in the portion of the housing interior including the swash plate, the spiral tube portion defining an interior space that is isolated from the housing interior, such that the pressure medium is spaced apart from the interior space of the spiral tube portion, and the spiral tube portion defining an exterior tube surface that is in contact with the pressure medium;

a drive machine fixedly connected to the hydraulic machine and configured to transmit a torque to the hydraulic machine; and a pressure medium container configured to contain the pressure medium, the pressure medium container fixedly connected to the hydraulic machine and configured to be connected to at least one of the low pressure connection and the high pressure connection.

13. The hydraulic assembly as claimed in claim 12, wherein the drive machine is an electric machine.

14. A hydraulic axle comprising:

a hydraulic machine comprising:

a housing defining a housing interior;

a group of hydrostatic working chambers mounted in the housing interior and configured for rotation about an axis of rotation, said working chambers configured such that, upon rotation of the group, said working chambers are connectable in an alternating manner to a high pressure connection of pressure medium of the hydraulic machine and to a low pressure connection of the pressure medium of the hydraulic machine;

a plurality of pistons, each piston at least partially positioned within a corresponding working chamber of the group of hydrostatic working chambers;

a swash plate operably connected to the plurality of pistons, wherein the pressure medium is located in a portion of the housing interior that includes the swash plate; and a heat exchanger device including a spiral tube portion located at least in the portion of the housing interior including the swash plate, the spiral tube portion defining an interior space that is isolated from the housing interior, such that the pressure medium is spaced apart from the interior space of the spiral tube portion, and the spiral tube portion defining an exterior tube surface that is in contact with the pressure medium;

a drive machine fixedly connected to the hydraulic machine and configured to transmit a torque to the hydraulic machine, a hydraulic cylinder fixedly connected to the hydraulic machine, the hydraulic machine configured to supply the pressure medium to the hydraulic cylinder; and a control block fixedly connected to the hydraulic machine and configured to control the supply of the pressure medium to the hydraulic cylinder.

15. The hydraulic axle as claimed in claim 14, wherein the drive machine is an electric machine and the control block is a valve control block.

* * * * *